US006702158B2

(12) United States Patent
Kageyama et al.

(10) Patent No.: US 6,702,158 B2
(45) Date of Patent: Mar. 9, 2004

(54) KNOCKING-TYPE LIQUID CONTAINER

(75) Inventors: Hidehei Kageyama, Kawagoe (JP); Yoshio Noguchi, Kawagoe (JP); Tadao Odaka, Kawagoe (JP); Tadashi Keda, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 157 days.

(21) Appl. No.: 10/005,077

(22) Filed: Dec. 7, 2001

(65) Prior Publication Data

US 2002/0070247 A1 Jun. 13, 2002

(51) Int. Cl.[7] ..... B67D 5/42

(52) U.S. Cl. ..... 222/386; 222/340; 222/341; 401/171; 401/179

(58) Field of Search ..... 222/340, 341, 222/386; 401/171, 179, 110, 111

(56) References Cited

U.S. PATENT DOCUMENTS

| | | | | | |
|---|---|---|---|---|---|
| 3,056,194 | A | * | 10/1962 | Kahn et al. | 29/434 |
| 3,205,863 | A | * | 9/1965 | Rhoades | 401/111 |
| 4,624,594 | A | * | 11/1986 | Sasaki et al. | 401/176 |
| 4,776,717 | A | * | 10/1988 | Iizuka et al. | 401/176 |
| 4,808,022 | A | * | 2/1989 | Iizuka et al. | 401/176 |
| 4,892,427 | A | * | 1/1990 | Ford | 401/182 |
| 5,827,002 | A | * | 10/1998 | Nakajima | 401/174 |
| 5,871,296 | A | * | 2/1999 | Furukawa et al. | 401/106 |
| 5,997,204 | A | * | 12/1999 | Ducrocq | 401/109 |
| 6,176,632 | B1 | | 1/2001 | Kageyama et al. | |
| 6,340,261 | B1 | * | 1/2002 | Furukawa | 401/216 |

FOREIGN PATENT DOCUMENTS

| | | |
|---|---|---|
| EP | 0 683 062 A1 | 11/1995 |
| EP | 1 018 309 A1 | 7/2000 |
| JP | 8-281192 | 10/1996 |

OTHER PUBLICATIONS

European Search Report dated Apr. 17, 2002.

* cited by examiner

*Primary Examiner*—Gene Mancene
*Assistant Examiner*—Frederick C. Nicolas
(74) *Attorney, Agent, or Firm*—McGinn & Gibb, PLLC

(57) ABSTRACT

A knock-type liquid container includes a body having a tank that holds a liquid, and an outlet provided at a forward end, a piston in the tank, and a piston-advancing mechanism having a knocking body that projects rearwardly of the body for advancing the piston forwardly when the knocking body is knocked in an axial direction of the container. A rearward end surface of the rear cap that forms a rear end surface of the container, except the knocking body is not normal to the axial direction, but makes an angle other than an approximate right angle with the axial direction. A distance between a rear end surface of the knocking body at a non-knocking position and a rearmost portion of the rearward end surface of the container, except the knocking body, is less than a stroke of the knocking body required for advancing the piston.

20 Claims, 11 Drawing Sheets

(a)

(b)

KNOCKING-TYPE LIQUID CONTAINER

BACKGROUND OF THE INVENTION

1. Field of the Invention

The present invention relates to a liquid container, and more particularly to a knock-type liquid container that holds a liquid such as cosmetic liquid, writing ink, or correcting liquid and has a liquid outlet provided at a tip portion of the container.

2. Description of the Related Art

A conventional liquid container that holds the above-mentioned type of liquid is disclosed in Japanese Patent Application (JPA) No. 2000-51919 applied for by the inventors of the present application.

This conventional knock-type liquid container aims to supply the liquid therein forwardly of the container by a user's knocking operation, and includes a tank, a piston, a threaded rod, a rotating cam, a knocking cam, and a knocking body. The tank holds a liquid therein and has a liquid outlet provided at the forward end thereof. The piston slides in the tank.

The threaded rod, integrally formed with the piston, extends rearwardly of the piston and has a male thread on its outer circumferential surface. The threaded rod is not rotatable relative to the tank. The rotating cam has a female threaded hole into which the male thread of the threaded rod is screwed. The knocking cam is disposed rearwardly of the rotating cam and causes the rotating cam to rotate in one direction. The knocking body is resiliently urged rearwardly relative to the knocking cam and is operated to perform a knocking operation. One of the knocking body and the knocking cam has a projection formed thereon and the other of the knocking body and the knocking cam has a beveled path that inclines in the axial direction and fittingly receives the projection. Knocking the knocking body causes the knocking cam to rotate, thereby causing the rotating cam to rotate.

This configuration allows the liquid to be supplied by a knocking operation of the knocking body. The configuration is advantageous in that the knocking operation requires only a one-hand operation, thereby providing good operability.

However, because of the simple nature of the knocking action, the knocking body may be knocked inadvertently, thereby causing the piston to advance forwardly to discharge the liquid from the tank. Therefore, conventionally, to prevent the knocking body from being inadvertently knocked, the force required to knock the knocking body should be sufficiently large (e.g., about 12.7 N=1.3 kg weight). However, such a relatively large force impairs the operability of the knocking body. This is a problem.

SUMMARY OF THE INVENTION

In view of the foregoing and other problems, drawbacks, and disadvantages of the conventional structures, an object of the present invention is to provide a liquid container in which even if a knocking body is knocked inadvertently, the liquid in the container is prevented from being discharged.

To attain the aforementioned and other objects, in an exemplary, non-limiting embodiment, a knock-type liquid container according to the present invention includes a body having a tank that holds a liquid therein and an outlet provided at a forward end, a piston in the tank, and a piston-advancing mechanism having a knocking body that projects rearwardly of the body for advancing the piston in the tank forwardly when the knocking body is knocked in an axial direction of the liquid container. A rear end of the liquid container, except for the knocking body, has a surface making an angle other than a right angle with the axial direction.

Hence, when the knocking body is inadvertently knocked by surroundings and the rear end of the knocking body is moved toward the liquid container (except the knocking body) until the rear end of the knocking body is flush with the rearmost portion of the rear end of the liquid container (except the knocking body), the knocking body is unable to move any further into the liquid container. Hence, the knocking body is prevented from being knocked at a most completely forward position in the axial direction. This prevents the piston from being advanced forwardly, thereby preventing unwanted discharge of the liquid through the liquid outlet of the body. When the user attempts to push the piston to discharge the liquid, he can discharge the liquid by knocking the knocking body into the container further than the rearmost portion of the rear end of the liquid container (except the knocking body).

When the knocking body is at a non-knocking position, a distance in the axial direction between a rear end surface of the knocking body and a rearmost portion of the rear end of the liquid container (except the knocking body) can be selected to be equal to or less than a stroke of the knocking body required for advancing the piston. Thereby, the rear end of the knocking body is knocked into the liquid container until the rear end of the knocking body is flush with the rearmost portion of the rear end of the liquid container (except the knocking body), and the piston is unable to advance any further. Thus, the liquid can be prevented from being discharged forwardly of the liquid outlet.

The piston-advancing mechanism can include a piston rod having a front end coupled to the piston, extending rearwardly of the piston, having a male thread on an outer circumferential surface thereof and prevented from rotating with respect to the tank, a piston rod guide having a female-threaded hole on a front inner circumferential surface, the female-thread hole receiving the male-threaded piston rod screwed thereinto, an inner sleeve into which the piston rod is unrotatably inserted, a rotating cam unrotatably mounted around an outer circumferential surface of the piston rod guide, the knocking body, a rear cap that includes a rotating cam mechanism together with the rotating cam and the knocking body, and a return spring that urges the rotating cam rearwardly.

The rotating cam mechanism converts an amount of knock of the knocking body into an amount of rotation of the rotating cam. Hence, when the knocking body is knocked, the rotating cam mechanism converts knocking of the knocking body into rotation of the rotating cam, so that the piston rod guide rotates. Because the male-threaded piston rod that is screwed into the female-threaded hole of piston rod guide cannot rotate relative to the tank, the piston rod advances so that the piston is pushed forwardly. The rotating cam mechanism allows for some "play" (e.g., delay) from the knocking of the knocking body until the rotating cam actually rotates, so that an inadvertent knocking does not cause the piston to advance forwardly by utilizing the play.

The piston-advancing mechanism can include a piston rod having a front end coupled to the piston, extending rearwardly of the piston, having a male thread on an outer circumferential surface thereof and prevented from rotating with respect to the tank, a rotating cam having a female threaded hole receiving the male thread of the piston rod screwed thereinto, a ratchet sleeve through which a piston rod extends, the ratchet sleeve being fixed forwardly of the rotating cam in the tank, a knocking cam that is positioned rearward of the rotating cam and can rotate the rotating cam, the knocking body, and a knock spring that is disposed between the knocking cam and the knocking body and resiliently urges the knocking body rearwardly.

One of the knocking body and the knocking cam has a projection formed thereon and the other of the knocking body and the knocking cam has a beveled path that inclines in the axial direction and fittingly receives the projection. The rotating cam has a front end with saw-teeth formed thereon and the ratchet sleeve is formed with a ratchet tooth that can mesh with the saw-teeth formed on the rotating cam and is movable to extend and retract in the axis direction. When the knocking body is knocked, the projection formed on one of the knocking body and the knocking cam moves in the beveled path formed on the other of the knocking body and the knocking cam, so that the knocking cam rotates and therefore the rotating cam rotates.

Because the male-threaded piston rod that is screwed into the female-threaded hole of the rotating cam cannot rotate relative to the tank, the piston rod advances so that the piston is pushed forwardly. There is some play before the saw-teeth of the rotating cam overrides the ratchet tooth of the ratchet sleeve. This play is utilized to prevent the piston from advancing forwardly when the knocking body is inadvertently knocked.

BRIEF DESCRIPTION OF THE DRAWINGS

The foregoing and other purposes, aspects and advantages of the present invention will become more fully understood from the detailed description given hereinbelow and the accompanying drawings which are given by way of illustration only, and thus are not limiting the present invention, and wherein:

FIG. 2(*b*) is a front view illustrating the rear cap 28 of FIG. 1;

FIG. 2(*c*) is a longitudinal cross-sectional view illustrating the rear cap 28 of FIG. 1;

FIG. 2(*d*) is a front view illustrating the state where a knocking body 32 is not knocked;

FIG. 2(*e*) is a front view illustrating the state where the knocking body 32 is knocked to supply liquid;

FIG. 3(*b*) is a longitudinal cross-sectional view of the knocking body 32 of FIG. 1;

FIG. 4(*b*) is a longitudinal cross-sectional view of the rotating cam 30 of FIG. 1;

FIG. 4(*c*) is a view seen in a direction shown by an arrow 4(*c*) of FIG. 4(*b*);

FIG. 7(*b*) is a longitudinal cross-sectional view of the inner sleeve 27 of FIG. 1;

DETAILED DESCRIPTION OF THE PREFERRED EMBODIMENTS

Figure 1:
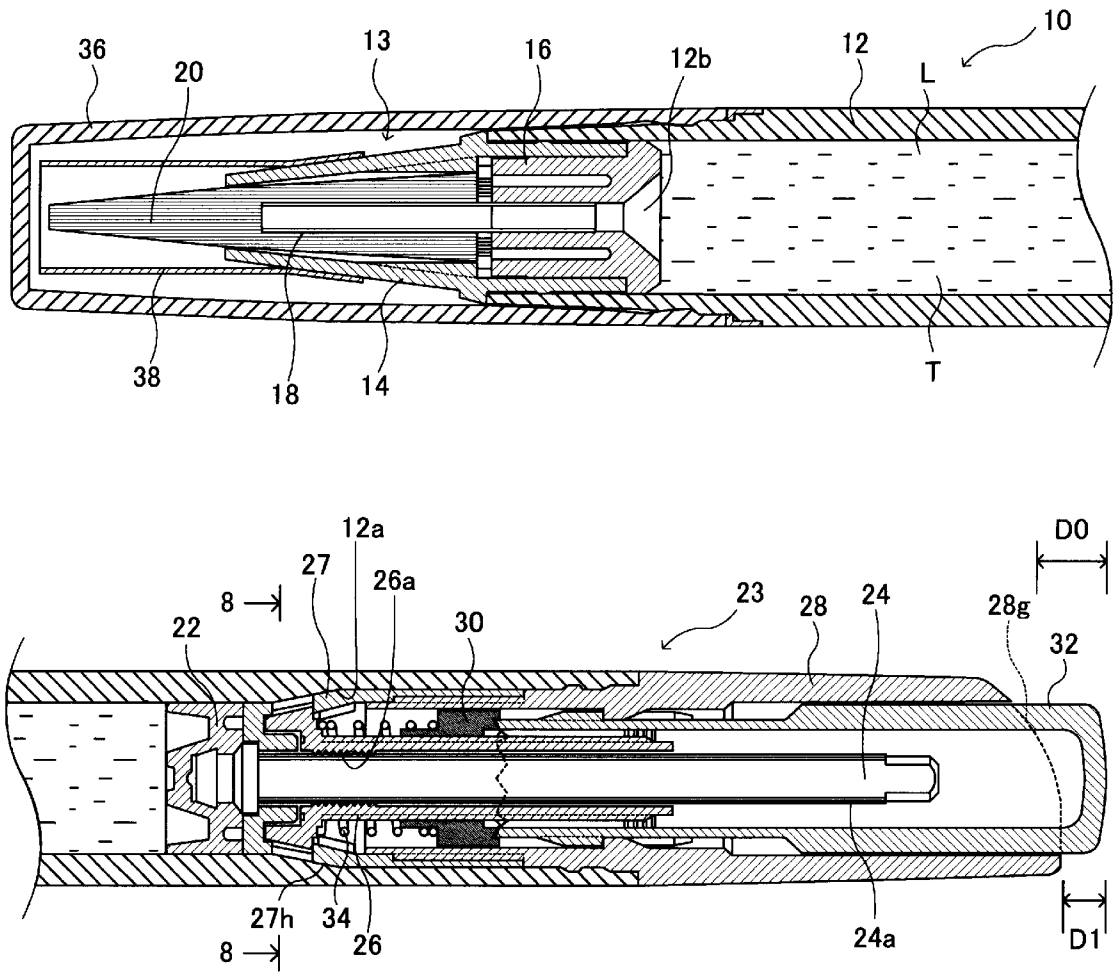
FIG. 1 is a longitudinal side view illustrating a liquid container 10 of a first embodiment of a liquid container according to the invention.

Embodiments of the invention will be described with reference to the accompanying drawings. In this specification, the terms "forward" and "forwardly" are used to cover the orientation toward the ink outlet of the liquid container and the terms "rearward" and "rearwardly" are used to cover the orientation toward the knocking body of the liquid container.

First Embodiment

FIGS. 1–8 illustrate a first embodiment of the present invention.

Referring to these drawings, a liquid container 10 generally includes a body 12 having a tank T which holds a liquid L such as correcting liquid, writing ink, and cosmetic liquid and having a liquid outlet 12*b* provided at a front end thereof, a front end unit 13 that is mounted to a forward end portion of the body 12, a piston 22 slidable in the tank T, and a piston-advancing mechanism 23 for advancing the piston 22 forwardly. The piston-advancing mechanism 23 is provided at a rearward portion of the liquid container 10.

The front end unit 13 includes a tapered sleeve 14 into which a forward end portion of the body 12 is press-fitted, a pipe holder 16 that is press-fitted into a rearward portion of the tapered sleeve 14, a forward end pipe 18 having a rear end portion securely fitted into the pipe holder 16, and a brush (i.e., a liquid-applier member) 20 having a base portion into which a front end portion of the forward end pipe 18 extends such that the base portion is sandwiched between the forward end pipe 18 and the tapered sleeve 14. When the liquid container is not in use, a cap 36 is detachably fitted over the forward end of the body 12 to protect the brush 20. When the liquid container 10 is shipped, a cover 38 is fitted over the tapered sleeve 14 to protect a tip of the brush 20.

The piston-advancing mechanism 23 includes a piston rod 24, a piston rod guide 26, an inner sleeve 27, a rear cap 28, a rotating cam 30, a knocking body 32, and a return spring 34. The piston rod 24 has a forward end portion coupled to the piston 22 and extends rearwardly from the piston 22, and has a male thread 24*a* provided on an outer circumferential surface. The piston rod guide 26 has a female-threaded hole 26*a* receiving the male thread 24*a* of the piston rod 24 screwed thereinto. The inner sleeve 27 receives a tip portion of the piston rod guide 26 and the piston rod 24 therein. The tip portion of the piston rod guide 26 is rotatably supported in the sleeve 27 while the piston rod 24 is unrotatably inserted into the inner sleeve 27. The rear cap 28 is connected to the inner sleeve 27. The piston rod guide 26 extends through the rotating cam 30 such that the rotating cam 30 is unrotatably mounted around the piston rod 26. The knocking body 32 projects rearwardly from the rear cap 28. The return spring 34 urges the rotating cam 30 rearwardly of the liquid container 10.

The piston-advancing mechanism 23 will be described in more detail hereinbelow.

Figure 2:
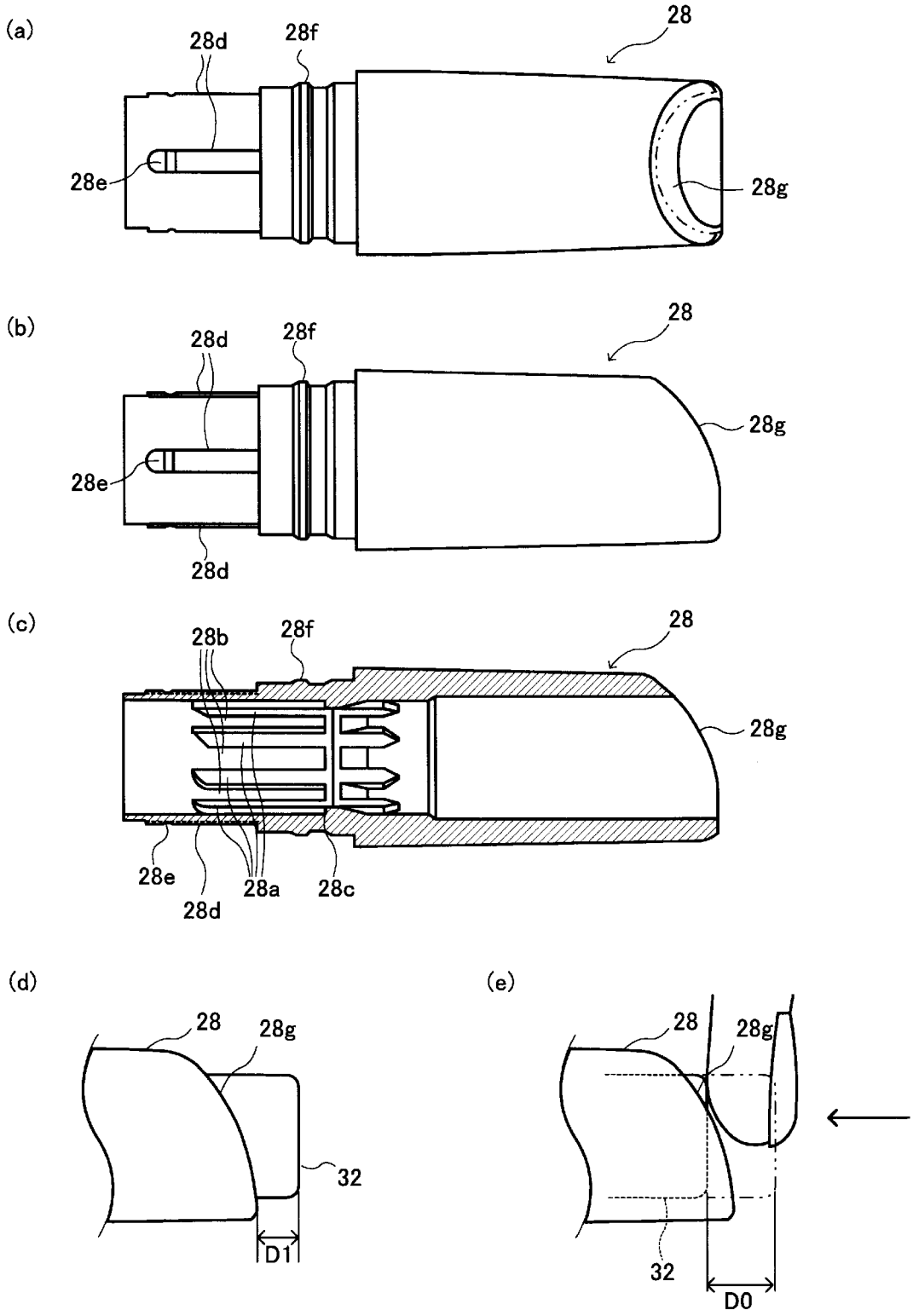
FIG. 2(*a*) is a top view illustrating a rear cap 28 of FIG. 1.

The rear cap 28, knocking body 32, and rotating cam 30 form a rotating cam mechanism. As shown in FIG. 2(*c*), the rear cap 28 has a plurality of cam projections 28*a* that are formed in an inner circumferential surface of the rear cap 28 at circumferential intervals.

Each of the cam projections 28*a* has a beveled cam surface formed at a front end portion thereof. The beveled cam surface inclines relative to the axial direction of the container 10. The rear ends of the cam projections 28*a* are continuous with an inwardly extending annular projection 28*c*. Cam grooves 28*b* formed between adjacent cam projections 28*a* slidably receive projections 32*a* (e.g., see FIG. 3) formed on an outer circumferential surface of the knocking body 32.

Figure 3:
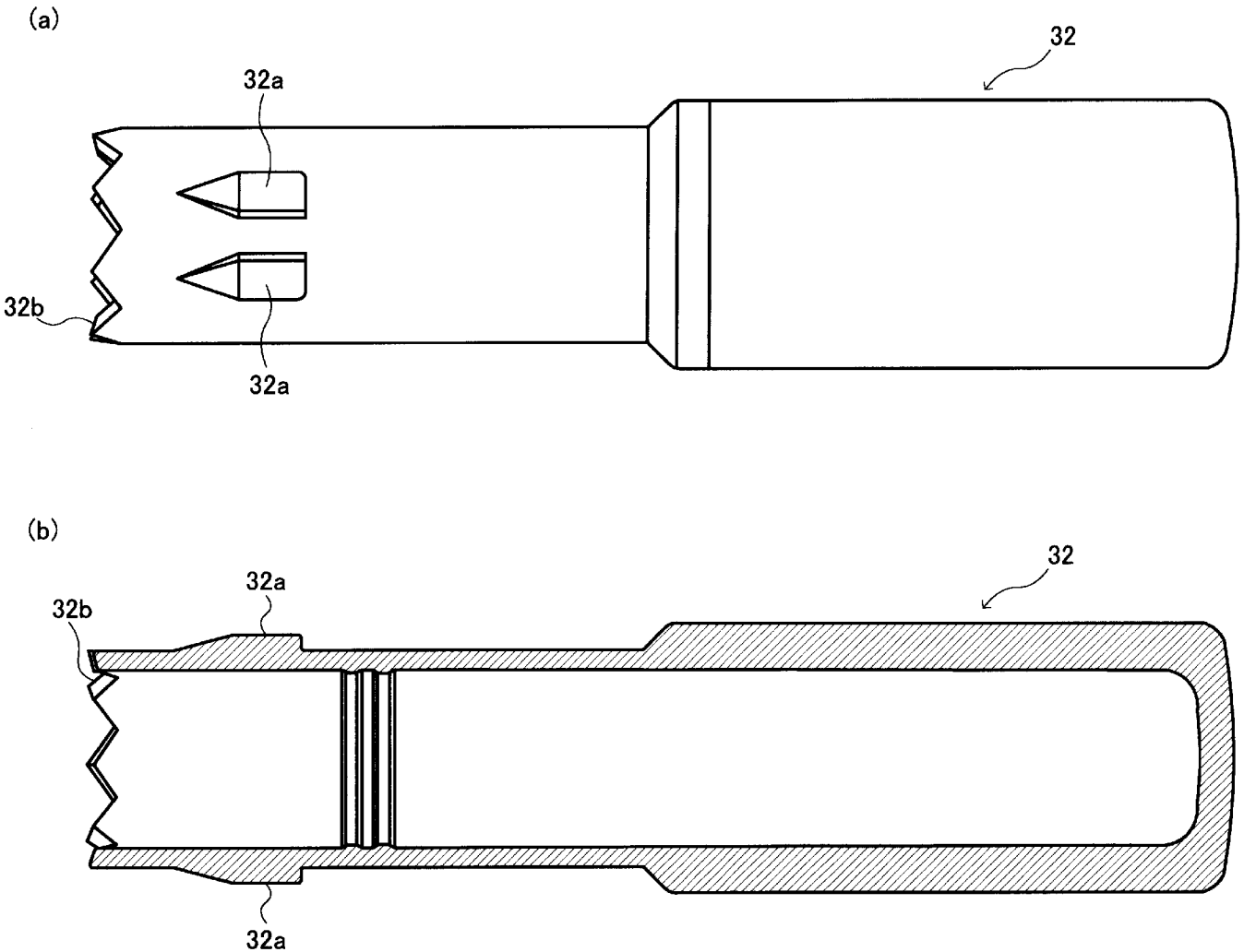
FIG. 3(*a*) is a top view of the knocking body 32 of FIG. 1.

As shown in FIG. 3, the knocking body 32 has a saw-tooth shaped cam surface 32*b* in its tip. The cam grooves 28*b* of the rear cap 28 also slidably receive projections 30*a* (e.g., see FIG. 4) formed on an outer circumferential surface of the rotating cam 30.

Figure 4:
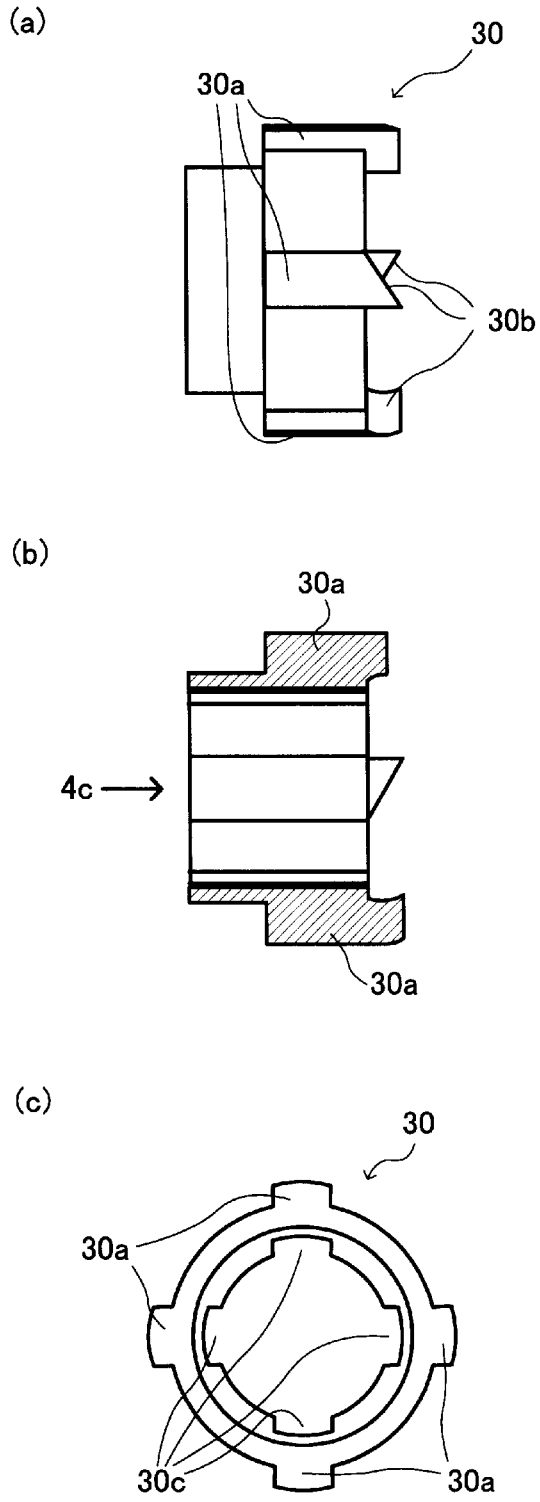
FIG. 4(*a*) is a top view of a rotating cam 30 of FIG. 1.
Figure 5:
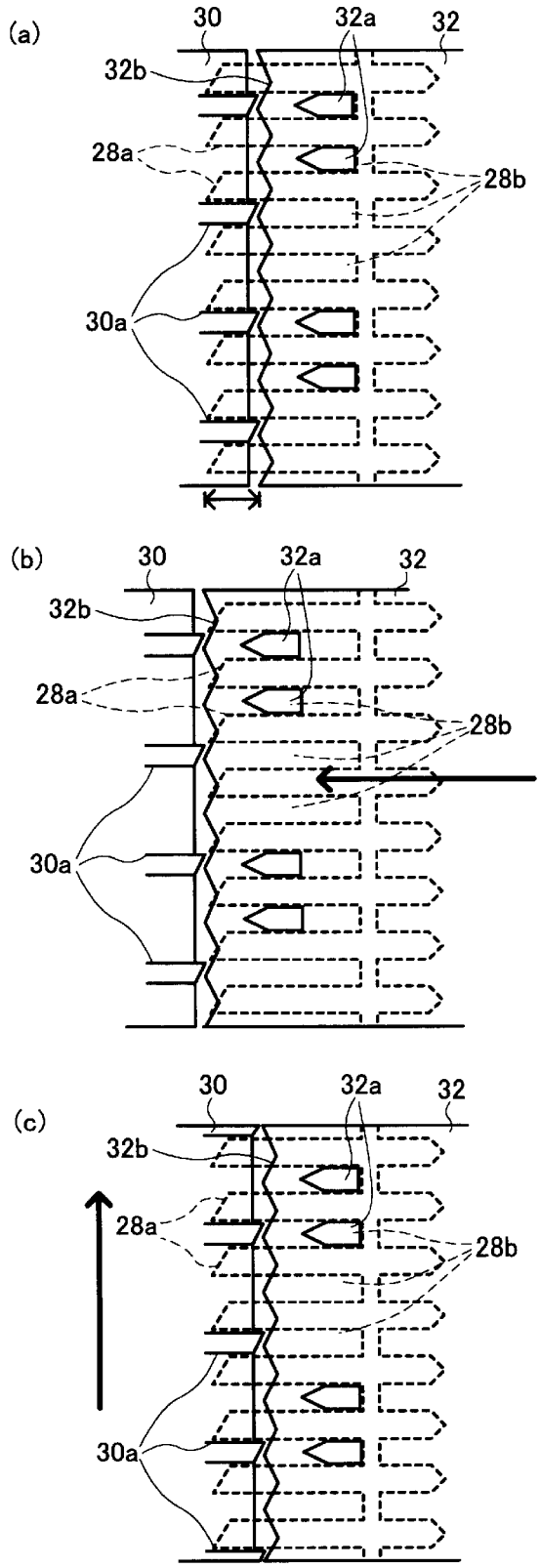
FIGS. 5(*a*) to 5(*c*) are illustrative diagrams of development views illustrating the operation of a rotating cam mechanism.

As shown in FIGS. 4(*a*)–4(*b*), each of the projections 30*a* of the rotating cam 30 has a beveled cam surface 30*b* formed at a rear end of the projection 30*a* and inclining relative to the axial direction of the container 10. When the knocking body 32 is forwardly knocked, the cam surface 32*b* of the knocking body 32 causes the rotating cam 30 to advance forwardly against the urging force of the return spring 34, so that the projections 30*a* of the rotating cam 30 are pushed forwardly of the cam grooves 28*b* of the rear cap 28. When the knocking force of the knocking body 32 is released subsequently, the urging force of the return spring 34 causes the cam surfaces 30*b* of the projections 30*a* of the rotating cam 30 to slide over the cam surfaces 32*b* of the knocking body 32 and the cam surfaces of cam projections 28*a* of the rear cap 28 toward adjacent cam grooves 28*b* so that the projections 30*a* fit into the cam grooves 28*b* (FIG. 5). Thus, every time the knocking body 32 performs one knocking operation, the rotating cam 30 rotates by an amount that the projections 30*a* of the rotating cam 30 move to adjacent cam grooves 28*b*.

As shown in FIG. 4(*c*), a plurality of axial grooves 30*c* are formed in an inner circumferential surface of the rotating cam 30. The axial grooves 30*c* fittingly receive axial ribs 26*b* (FIG. 6) of the piston rod guide 26 so that the rotating cam 30 and the piston rod guide 26 can rotate together.

Figure 6:
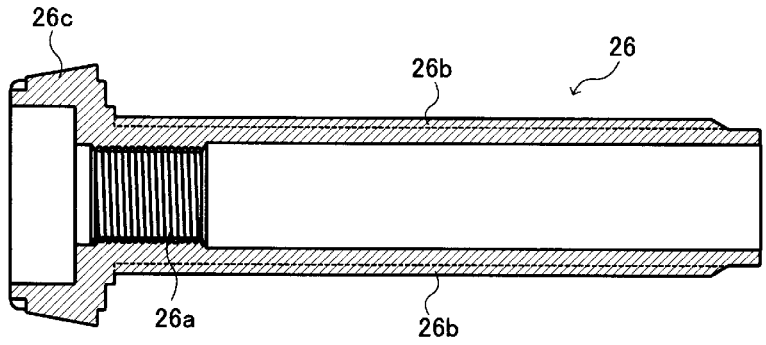
FIG. 6 is a longitudinal cross-sectional view of a piston rod guide 26 of FIG. 1.

As shown in FIG. 6, a forward end portion of the piston rod guide 26 is formed with an annular projection 26*c* having a larger outer diameter than the rest of the piston rod guide 26.

Figure 7:
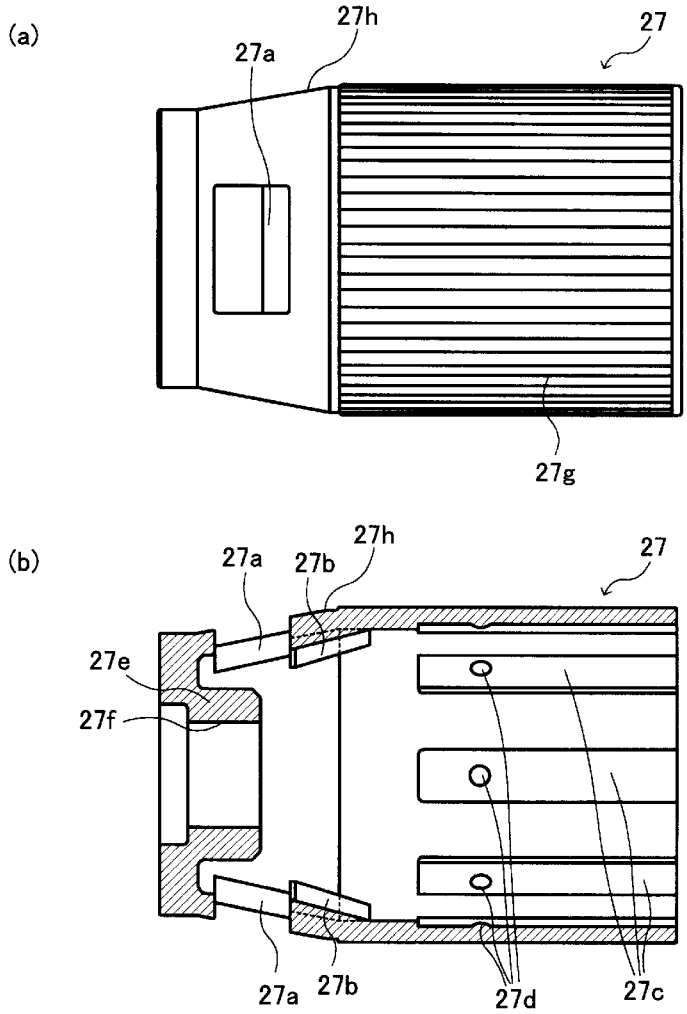
FIG. 7(*a*) is a top view of an inner sleeve 27 of FIG. 1.

As shown in FIG. 7, the inner sleeve 27 has a pair of windows 27*a* formed on the outer circumferential surface thereof. The inner sleeve 27 has a tapered inner circumferential surface near the windows 27*a*, the tapered inner circumferential surface increasing in diameter toward the rear end. The tapered inner circumferential surface has projections 27*b* formed at locations closer to the rear end than the windows 27*a*, the projections 27*b* being at the same circumferential position as the window 27*a*. The shortest distance between the forward ends of the opposing projections 27*b* is the same as the diameter of the inner sleeve 27 at the forward ends of the window 27*a*. The annular projections 26*c* of the piston rod guide 26 engage the projections 27*b* of the inner sleeve 27 so that the piston rod guide 26 is rotatable relative to the inner sleeve 27 but is not pulled out rearwardly from the inner sleeve 27, and consequently the axial direction position of the piston rod guide 26 is fixed.

The inner sleeve 27 has a plurality of axial grooves 27*c* formed on the inner circumferential surface at a location more rearward than the projections 27*b*. The axial grooves 27*c* fittingly receive axial ribs 28*d* formed in the forward end portion of the outer circumferential surface of the rear cap 28 of FIG. 2 while at the same time projections 27*d* formed on the bottoms of the axial grooves 27*c* fit into small holes 28*e* formed in the axial ribs 28*d*, so that the inner sleeve 27 and rear cap 28 are integrally coupled together.

Figure 8:
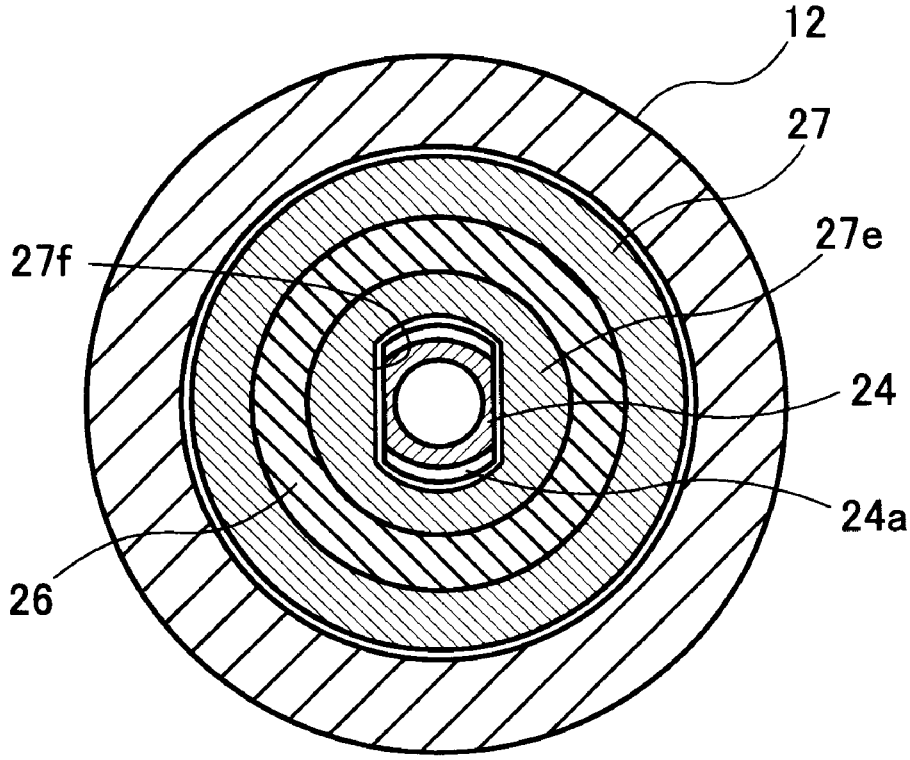
FIG. 8 is a transverse cross-sectional view taken along line 8—8 of FIG. 1.

As shown in FIG. 8, the piston rod 24 has a non-circular cross section. For example, in the present embodiment, the piston rod 24 is in the shape of a deformed cylinder that has been partially cut away in two planes parallel to the longitudinal axis of the piston rod 24.

The inner sleeve 27 has a small-diameter inner sleeve portion 27*e* that has a bore 27*f* which the piston rod 24 penetrates. The bore 27*f* has the same cross section as that of the piston rod 24. As the piston rod 24 penetrates the bore 27*f*, the piston rod 24 is unrotatable relative to the inner sleeve 27. The outer surface of the inner sleeve 27 has a knurled outer surface 27*g* in a part thereof, the knurled outer surface 27*g* fitting to ribs formed in a part of the inner circumferential surface of the body 12. A knurled fitting structure forms a rotation-preventing construction that prevents the inner sleeve 27 from relatively rotating with respect to the body 12. Of course, the knurled fitting construction may be replaced by another fitting construction such as a rib-fitting structure, polygon-fitting structure, and a key-and-key groove fitting structure or the like, each of which can prevent relative rotation of the body 12 and inner sleeve 27.

As described above, the inner sleeve 27 is prevented from rotating with respect to the piston rod 24. Thus, the piston rod 24 cannot rotate with respect to the body 12. A tapered surface 27*h* is formed adjacent to the knurled outer surface 27*g* and is smaller in diameter nearer the forward end of the liquid container. The tapered surface 27*h* abuts a tapered surface 12*a* formed on the inner surface of the body 12 that is smaller in diameter nearer the forward end of the liquid container. The rear cap 28 is press-fitted into the body 12 to be securely fixed to the body 12. The inner sleeve 27 is fixed in the body 12 such that the inner sleeve 27 is sandwiched between the tapered surface 12*a* of the body 12 and the rear cap 28.

As shown in FIGS. 2(*a*)–2(*e*), the rear end surface of the rear cap 28, which forms a rear end surface of the liquid container 10 (except for the knocking body 32), is a beveled end surface 28*g* which is not normal to the axial direction, but is at an angle with the axis of the liquid container 10. An axial distance D1 (e.g., see FIG. 1) between the rearmost portion of the beveled end surface 28*g* and a rear end surface of the knocking body 32 when the knocking body 32 is at a non-knocking position is equal to or shorter than a stroke of the knocking body 32 required for advancing the piston 22, as described below.

The piston-advancing mechanism 23 can be assembled into an integral subassembly separate from the body 12. The integral sub-assembly can be assembled into the body 12 by press-fitting the rear cap 28 of the integral sub-assembly into the body 12 from the rear end. The front end unit 13 can also be assembled as an integral sub-assembly separate from the body 12. After the piston-advancing mechanism 23 is assembled into the body 12, the liquid L is introduced into the body 12 through a forward inlet of the body 12, and finally the front end unit 13 is press-fitted into the body 12, thereby completing the assembly of the liquid container 10.

When the user attempts to discharge from the liquid container 10, the cap 36 and cover 38 are removed from the liquid container 10 and then the liquid L is applied to, for example, paper by using the brush 20. If the user wishes to supply more of the liquid through the brush 20, the user operates the knocking body 32 to perform the knocking operation with respect to the body 12.

As described above, every time the knocking body 32 is knocked one time, the rotating cam 30 rotates by an angle by which the projections 30*a* of the rotating cam 30 move circumferentially to adjacent cam grooves 28*b* so that the piston rod guide 26 rotates together with the rotating cam 30. The piston rod 24 does not rotate with respect to the body 12, and therefore the piston rod guide 26 rotates with respect to the piston rod 24 so that the piston rod 24 and piston 22 advance through threaded-engagement between the male thread 24*a* of the piston rod 24 and the female-threaded hole 26*a* of the piston rod guide 26. The advancement of the piston 22 in the tank T pushes the liquid L in the tank T toward the liquid outlet 12*b* provided at the forward end of the body 12, then the liquid passes through the pipe 18, and is finally discharged from the tip of the brush 20.

When the liquid container 10 is carried in, for example, a handbag or the like, if the knocking body 32 is pushed accidentally by something else in the handbag, the knocking body 32 may be easily pushed and knocked until the rear end surface of the knocking body 32 is flush with the rearmost portion of the beveled end surface 28*g* of the rear cap 28. However, the distance D1 (e.g., see FIGS. 1 and 2(*b*)) between the rearmost portion of the beveled end surface 28*g* of the rear cap 28 and the rear end surface of the knocking body 32 when the knocking body 32 is at a non-knocking position is shorter than a stroke of the knocking body 32 required for advancing the piston 22.

Thus, even if the knocking body 32 is knocked until the rearmost portion of the beveled end surface 28*g* is flush with the rear end surface of the knocking body 32, the piston 22 is not advanced yet. The stroke D0 of the knocking body 32 required for advancing the piston 22 is a distance over which the knocking body 32 moves to cause the projections 30*a* of the rotating cam 30 to advance forwardly from the cam grooves 28*b* of the rear cap 28.

As described above, after the projections 30*a* of the rotating cam 30 have been pushed forwardly from the cam grooves 28*b*, and the knocking force of the knocking body 32 is released, the projections 30*a* move to adjacent cam grooves 28*b* along the cam surface 32*b* of the knocking body 32 and the cam surface of the cam projections 28*a* of the rear cap 28, so that the rotating cam 30 can rotate. However, if the stroke of the knocking body 32 is not enough for the projections 30*a* of the rotating cam 30 to advance forwardly from the cam grooves 28*b*, a decrease in knocking force of the knocking body 32 causes the projections 30*a* to retract into the same cam grooves 28*b* so that the rotating cam 30 does not rotate.

As a result, the rotating cam 30 moves only back and forth somewhat and the piston rod guide 26 does not rotate, preventing the piston 22 from advancing. If the knocking body 32 bumps some object and is pushed by the object, the knocking body 32 enters a so-called "half knock condition (D1 of FIGS. 1 and 2(*d*))," (i.e., the rear end of the knocking body 32 becomes flush with the rearmost position of the beveled end surface 28*g*). In this manner, the piston 22 is prevented from pushing the liquid out of the liquid container 10. When the user operates intentionally the knocking body 32 so that the rear end of the knocking body 32 advances forwardly further than the rearmost portion of the beveled surface 28*g* of the rear cap 28 (D0 of FIGS. 1 and 2(*e*)), the piston 22 advances to discharge the liquid.

Figure 12:
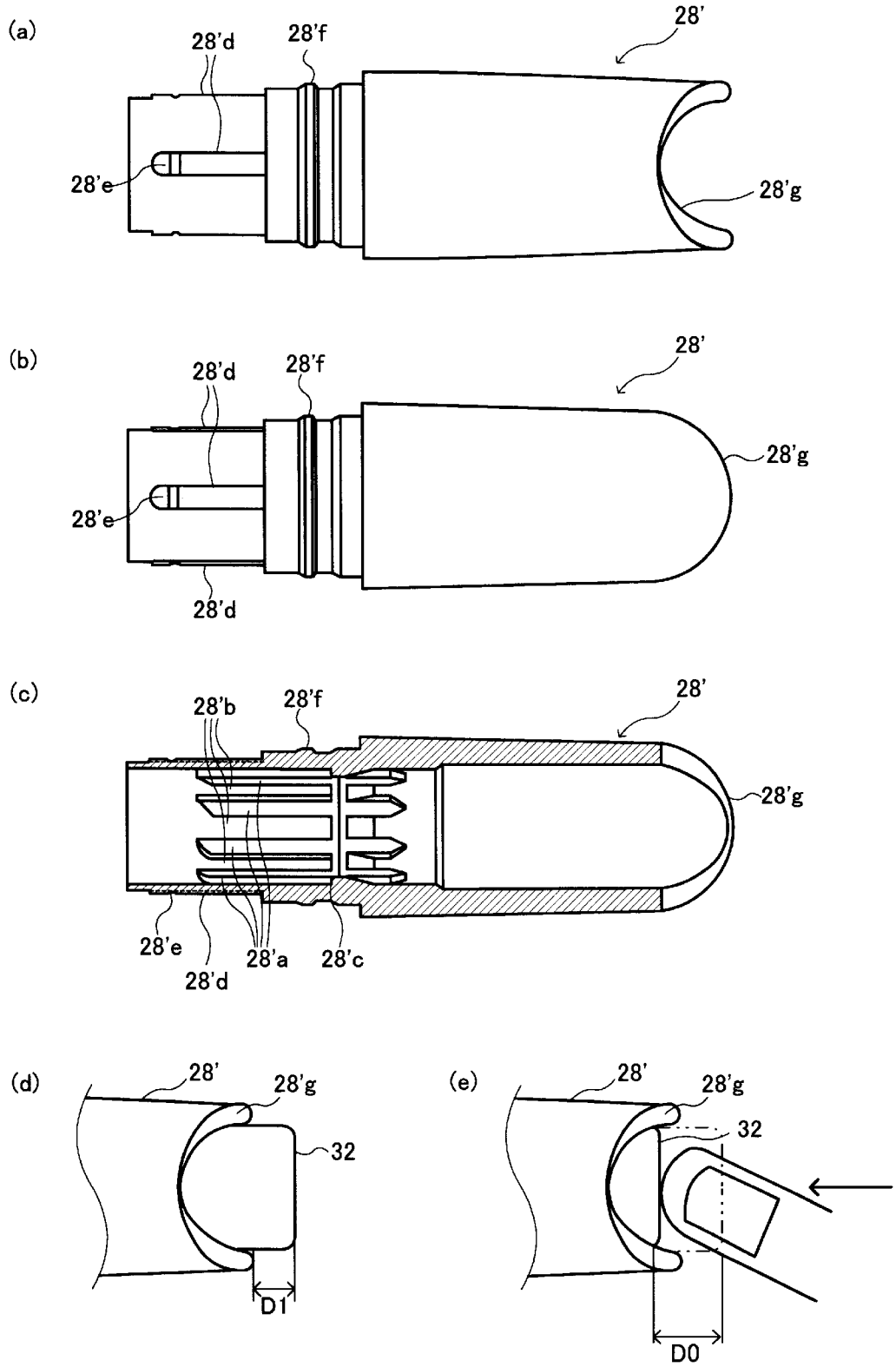
FIGS. 12(*a*)–12(*e*) illustrate an example of a modification of the rear cap of FIG. 2, with FIG. 12(*a*) being a top view, FIG. 12(*b*) being a front view, FIG. 12(*c*) being a longitudinal cross-sectional view, FIG. 12(*d*) being a front view of the rear end portion of the rear cap 54, and FIG. 12(*e*) being a front view when the knocking body is knocked to the liquid.

FIG. 12 illustrates another beveled end surface 28'g of the rear cap 28' that is a modification of the beveled end surface 28*g* of the rear cap 28. The opposing two points of the beveled end surface 28'g are rearmost points of the rear cap 28'.

Second Embodiment

Figure 9:
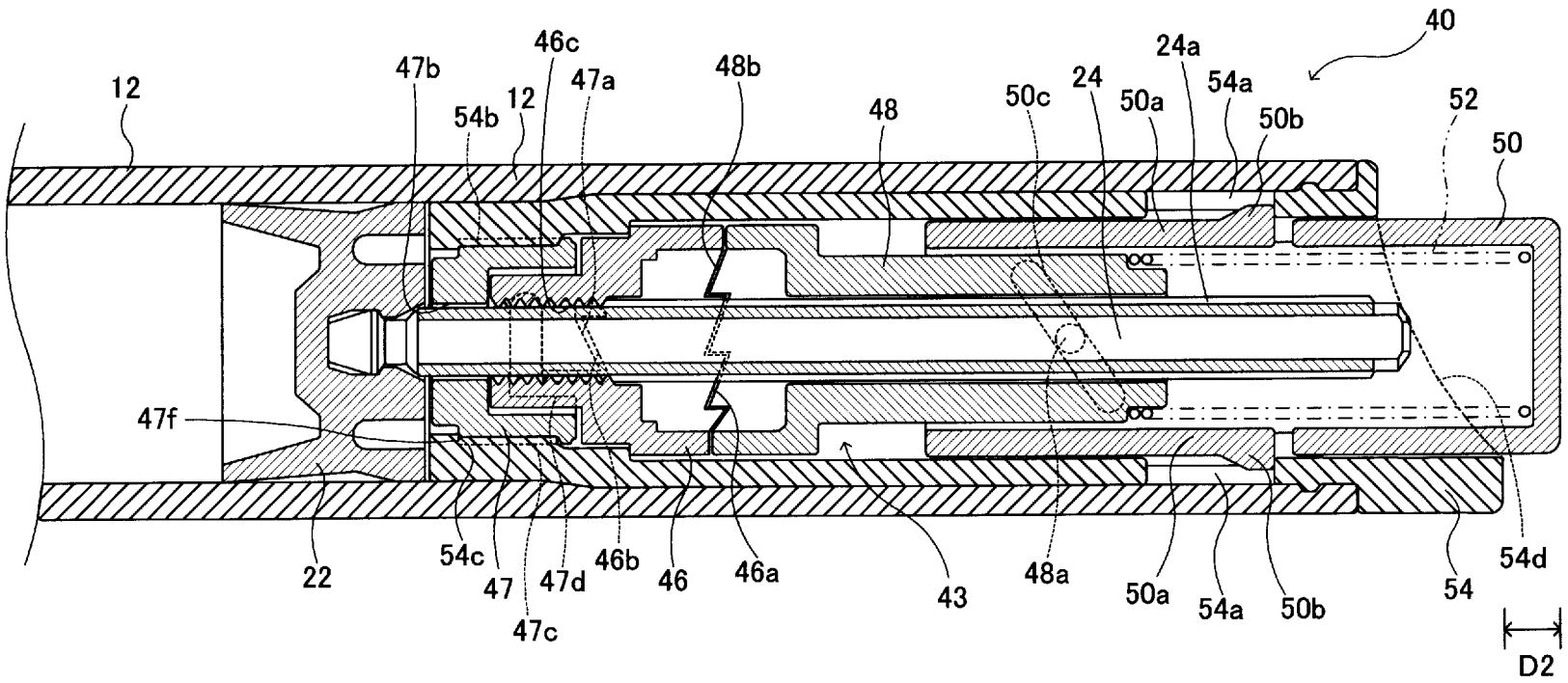
FIG. 9 is a rear longitudinal cross-sectional view of a liquid container 40 according to a second embodiment of the invention.
Figure 10:
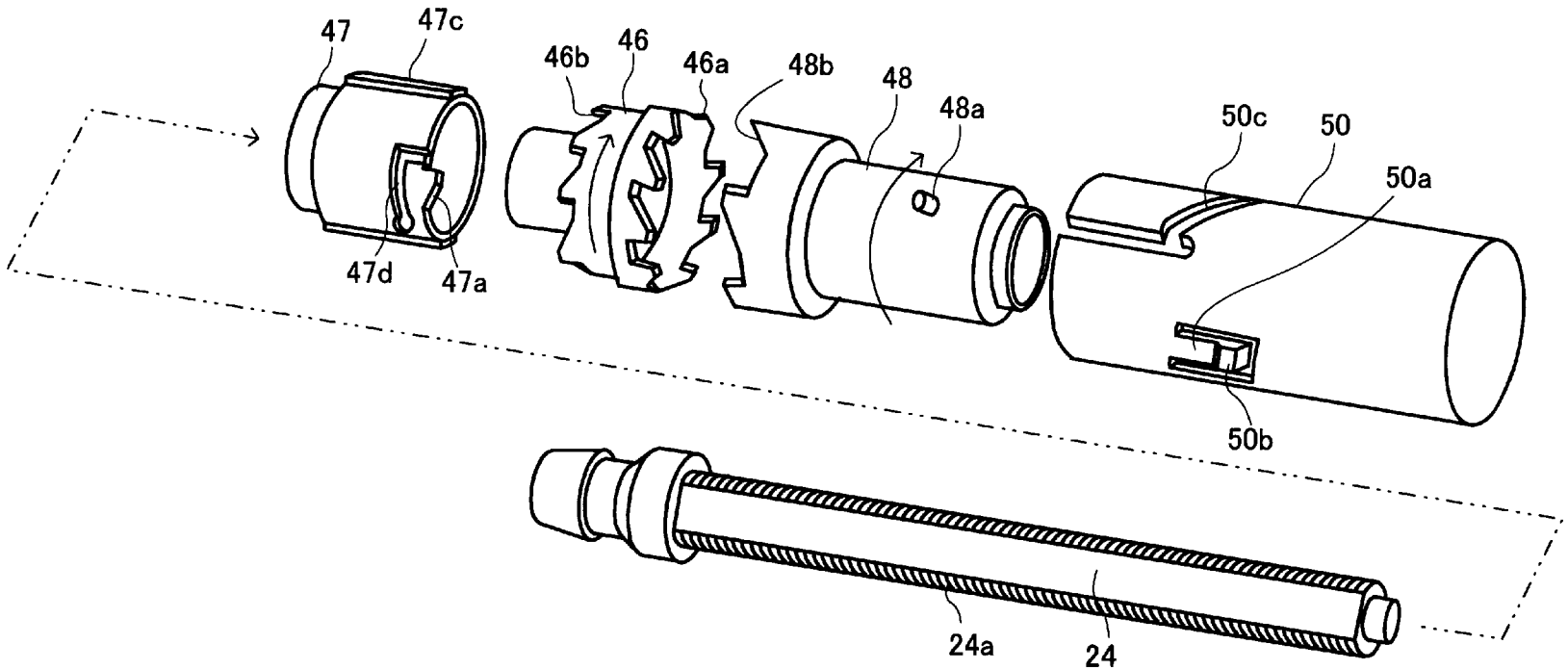
FIG. 10 is an exploded perspective view of a piston-advancing mechanism 43 of FIG. 9.
Figure 11:
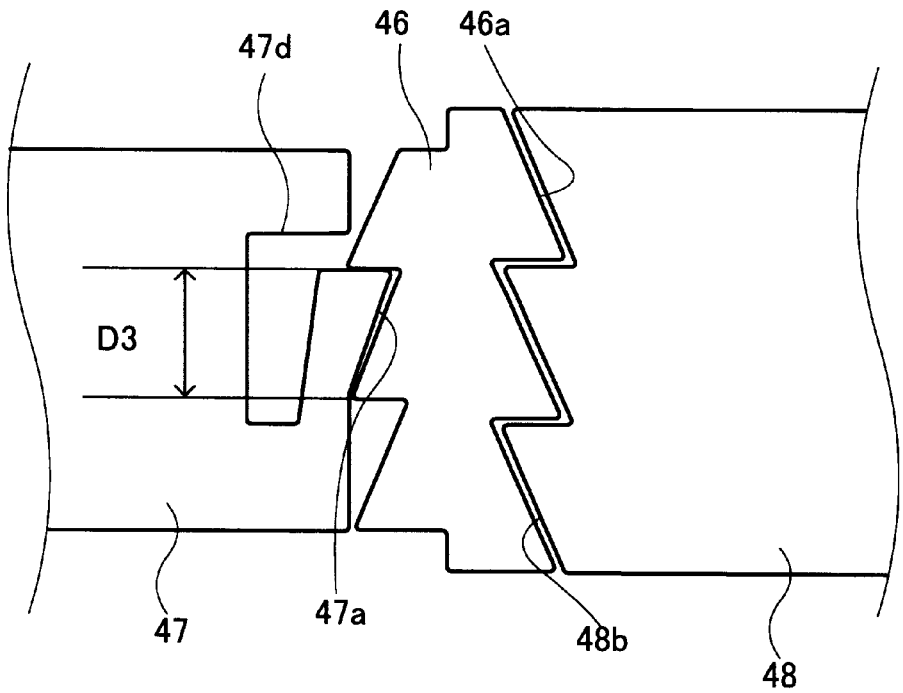
FIGS. 11(*a*)–11(*b*) are illustrative diagrams of a side view illustrating the operation of the rotating cam 46 and a ratchet sleeve 47 of FIG. 9.
Figure 11:
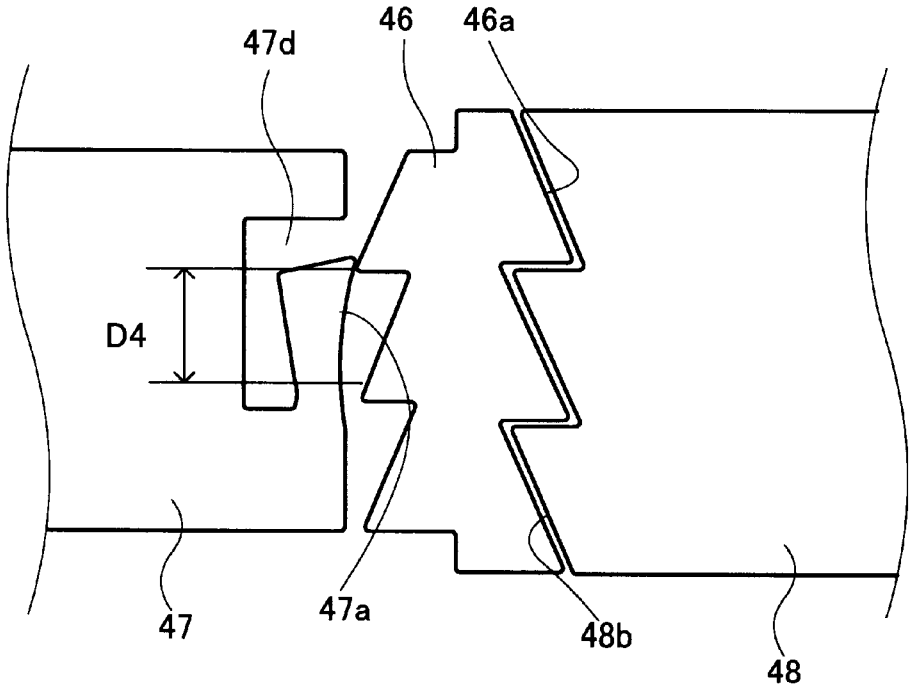

FIGS. 9–11 illustrate a second embodiment of the invention. Referring to FIGS. 9–11, a liquid container 40 generally includes the body 12, the front end unit 13, the piston 22 slidable in the tank T, and a piston-advancing mechanism 43 provided at a rear portion of the liquid container 40 for advancing the piston 22 forwardly. As the front end unit 13 is of the same construction as the first embodiment, the description and drawings are omitted.

The piston-advancing mechanism 43 includes a piston rod 24, a rotating cam 46, a ratchet sleeve 47, a knocking cam 48, a rear cap 54 fixed at an end of the tank T, a knocking body 50 that protrudes rearwardly of the rear cap 54, and a knocking spring 52. The piston rod 24 is coupled integrally with the piston 22 and extends rearwardly. The piston rod 24 has a male thread 24*a* on its outer circumferential surface. The rotating cam 46 is formed with a female thread hole 46*c* therein into which the male thread 24*a* of the piston rod 24 is screwed. The ratchet sleeve 47, through which the piston rod 24 extends, is fixed in the tank T at a location forward of the rotating cam 46. The knocking cam 48 is at a location rearward of the rotating cam 46 and can rotate the rotating cam 46. The knocking spring 52 is mounted between the knocking cam 48 and knocking body 50 and resiliently urges the knocking body 50 rearwardly.

The piston-advancing mechanism 43 will now be described in more detail hereinbelow.

The rear cap 54 has a pair of window holes 54*a* formed on an outer circumferential surface thereof. The window holes 54*a* receive resilient projections 50*b* formed on the tip of resilient straps 50*a* formed on the circumferential surface of the knocking body 50. The resilient projections 50*b* slide in the windows 54*a* so that the knocking body 50 is movable axially and not rotatable with respect to the rear cap 54.

The knocking body 50 has a beveled groove 50*c* formed in a side surface thereof, the beveled groove 50*c* being at an angle with regard to an axis of the liquid container 40. The beveled groove 50*c* receives a projection 48*a* formed on the outer side surface of the knocking cam 48 so that the projection 48*a* is movable along the beveled groove 50*c*.

The knocking cam 48 has saw-teeth 48*b* formed in a forward end thereof. The saw-teeth 48*b* can mesh with saw-teeth 46*a* formed in a rear end of the rotating cam 46. Further, the rotating cam 46 has saw-teeth 46*b* formed at a front end thereof, an inclined surface of the saw-teeth 46*b* are in an opposite direction to an inclined surface of the saw-teeth 46*a* formed at the rear end of the rotating cam 46. The saw-teeth 46*b* can mesh with a ratchet tooth 47*a* formed at a rear end of the ratchet sleeve 47, and the ratchet tooth 47*a* is resiliently deformable by an L-shaped slit 47*d* so that the ratchet tooth 47*a* can protrude or retract in the axial direction.

The ratchet sleeve 47 has an elongated insertion bore 47*b* of which a cross section is the same shape as the cross section of the piston rod 24, so that the piston rod 24 unrotatably extends through the insertion bore 47*b*. The ratchet sleeve 47 has a plurality of axial ribs 47*c* formed on an outer circumferential surface thereof. The axial ribs 47*c* fit axial grooves 54*b* formed on an inner circumferential surface of the rear cap 54 so that the ratchet sleeve 47 is unrotatable with respect to the rear cap 54. Stepped surface 47*f* facing a forward end of the ratchet sleeve 47 abuts a stepped surface 54*c* facing a rear end of the rear cap 54.

Thus, the ratchet sleeve 47 is fixed with respect to the rear cap 54. Because the rear cap 54 is press-fitted into the body 12, the ratchet sleeve 47 is fixed relative to the body 12. As described above, the ratchet sleeve 47 is prevented from rotating with respect to the piston rod 24, and thus, the piston rod 24 cannot rotate relative to the body 12.

The rear end surface of the rear cap 54 that forms a rear end surface of the liquid container 40 (except for the knocking body 50) is not normal to the axis of the liquid container 40, but is a beveled surface 54*d* cut at an angle with the axis of the container 40. The distance D2 (see FIG. 9) between a rearmost portion of the beveled surface 54*d* and a rear end surface of the knocking body 50 is equal to or somewhat shorter than the stroke of the knocking body 50 required for advancing the piston 22.

Similarly to the first embodiment, the piston-advancing mechanism 43 can be integrally assembled into an integral sub-assembly separate from the body 12. The integral sub-assembly can be assembled into the body 12 by press-fitting the rear cap 54 of the integral sub-assembly into the body 12 from the rear end. After the piston-advancing mechanism 43 is assembled to the body 12, then the liquid L is introduced through the forward opening of the body 12, and finally the front end unit 13 is press-fitted into the body 12, thereby completing the assembly of the liquid container 40.

When the liquid L is discharged from the liquid container 40 of the above described construction, the brush 20 is used to apply the liquid L to an object. If more of the liquid L should be discharged through the brush 20, the user performs a knocking operation of the knocking body 50.

When the knocking body 50 is advanced by the knocking operation, the knocking cam 48 cannot advance, but the projection 48*a* of the knocking cam 48 moves along the beveled groove 50*c* of the knocking body 50, so that the knocking cam 48 rotates in a direction shown by an arrow of FIG. 10. Because the saw-teeth 48*b* of the knocking cam 48 mesh with the saw-teeth 46*a* of the rotating cam 46, the rotation of the knocking cam 48 causes the rotating cam 46 to rotate in the same direction. At this moment, the saw-teeth 46*b* of the rotating cam 46 rotate with sliding on the beveled surface of the ratchet tooth 47*a* formed in the ratchet sleeve 47 and also causing the ratchet tooth 47*a* to extend and retract.

Because the ratchet sleeve 47 prevents the piston rod 24 from rotating, when the rotating cam 46 rotates in the direction of the arrow, the piston rod 24 threadably engaged with the rotating cam 46 advances to push the piston 22. The piston 22 pushes the liquid L in the body 12, so that the liquid L passes through the pipe 18 and is discharged through the brush 20.

It is noted that, in the second embodiment, the knocking body 50 may be inadvertently knocked. That is, when the liquid should not be discharged, if some object bumps the knocking body 50, then the knocking body 50 may be moved at least over the distance D2 without difficulty. However, because the distance D2 is substantially the same as or somewhat shorter than the stroke over which the knocking body 50 should move to cause the piston 22 to advance, even if the knocking body 50 is knocked until the rear end of the knocking body 50 becomes flush with the rearmost portion of the beveled surface 54*d* of the rear cap 54, the piston 22 is not pushed forwardly yet.

In other words, when the knocking cam 48 moves in the circumferential direction at least a minimum distance D3 as shown in FIG. 11(*a*), required for one of the saw-teeth 46*b* of the rotating cam 46 to push the ratchet tooth 47*a* out of the way to pass the ratchet tooth 47*a*, the rotating cam 46 rotates positively to ensure that the piston rod 24 and the piston 22 are advanced. Thus, the stroke of the knocking body 50 required for the rotating cam 46 and knocking cam 48 to move the circumferential distance D3 is equal to the stroke of the knocking body 50 required for the piston 22 to advance.

On the other hand, as shown in FIG. 11(*b*), when the knocking cam 48 moves over a circumferential distance D4 (<D3) which is not long enough for one of the saw teeth 46*b* to push the ratchet tooth 47*a* out of the way to pass the ratchet tooth 47*a* of the ratchet sleeve 47, if the knocking operation of the knocking body 50 is released, then the rotating cam 46 and knocking cam 48 rotate in the opposite directions to return to their original positions.

Accordingly, the piston rod 24 and piston 22 advance part way, but return as the rotating cam 46 returns to its original position. Therefore, the liquid L in the tank T is once discharged from the tank T, but is sucked back into the tank T, so that the liquid is prevented from being discharged. When the user attempts to discharge the liquid from the liquid container, the user knocks the rear end of the knocking body 50 deeper than the rearmost portion of the beveled surface 54*d* of the rear cap 54 so that the piston 22 can advance to normally discharge the liquid from the liquid container 40.

As described above, in each of the embodiments, the force required for normal knocking can be set less than a maximum of 9.8 N (=1 kg weight), for example, within a range of about 2.9–4.9 N (=300 to 500 g weight) that can be applied normally, and yet can prevent unwanted discharge of liquid due to an inadvertent knocking operation.

In the present invention, a component described as a single component may be replaced with an integral assembly of a plurality of components. Also, an integral assembly described as a plurality of components may be replaced with a single component.

Hence, as described above, according to the present invention, an inadvertent knocking operation does not allow the piston to advance sufficiently, thereby preventing unwanted discharge of liquid from the container without having to increase the force required for knocking of the knocking body. Thus, the normal knocking operation can be performed comfortably with a force that the user can normally apply.

With the invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A knock-type liquid container, comprising:

a body having a tank that holds a liquid therein, and an outlet provided at a forward end of said body;

a piston positioned in the tank; and a piston-advancing mechanism having a knocking body that projects rearwardly of said body for advancing said piston in the tank forwardly when said knocking body is knocked in an axial direction of the liquid container, wherein a rear end opening of the liquid container, through which said knocking body passes, defines a surface making an angle other than an approximate right angle with the axial direction of the liquid container.

2. A knock-type liquid container, comprising:

a body having a tank that holds a liquid therein, and an outlet provided at a forward end of said body;

a piston positioned in the tank: and a piston-advancing mechanism having a knocking body that projects rearwardly of said body for advancing said piston in the tank forwardly when said knocking body is knocked in an axial direction of the liquid container.

wherein a rear end of the liquid container, other than said knocking body, has a surface making an angle other than an approximate right angle with the axial direction of the liquid container, wherein when said knocking body is at a non-knocking position, a distance in the axial direction between a rear end surface of the knocking body and a rearmost portion of the rear end of the liquid container, other than said knocking body, is selected to be equal to or less than a stroke of said knocking body required for advancing said piston.

3. The knock-type liquid container according to claim 2, wherein said piston-advancing mechanism comprises:

a piston rod having a front end coupled to said piston, extending rearwardly of said piston, having a male thread on an outer circumferential surface thereof and prevented from rotating with respect to the tank;

a piston rod guide having a female threaded hole on a front inner circumferential surface, said female thread hole receiving said piston rod screwed thereinto;

an inner sleeve into which said piston rod is unrotatably inserted;

a rotating cam unrotatably mounted around an outer circumferential surface of said piston rod guide;

said knocking body;

a rear cap forming a rotating cam mechanism together with said rotating cam and said knocking body; and a return spring that urges said rotating cam rearwardly, wherein said rotating cam mechanism converts an amount of knock of said knocking body into an amount of rotation of said rotating cam.

4. The knock-type liquid container according to claim 2, wherein said piston-advancing mechanism comprises:

a piston rod having a front end coupled to said piston and extending rearwardly of said piston, having a male thread on an outer circumferential surface thereof and prevented from rotating with respect to the tank;

a rotating cam having a female threaded hole receiving the male thread of said piston rod screwed thereinto;

a ratchet sleeve through which a piston rod extends, said ratchet sleeve being fixed forwardly of said rotating cam in the tank;

a knocking cam that is positioned rearwardly of said rotating cam and can rotate said rotating cam;

the knocking body; and a knock spring that is disposed between said knocking cam and said knocking body and resiliently urges said knocking body rearwardly, wherein one of said knocking body and said knocking cam includes a projection formed thereon and the other of said knocking body and said knocking cam includes a beveled path that inclines in the axial direction and fittingly receives said projection, and wherein said rotating cam has a front end with saw-teeth formed therein and said ratchet sleeve is formed with a ratchet tooth that can mesh with the saw-teeth formed in the front end of said rotating cam and is movable to extend and retract in the axial direction.

5. A knock-type liquid container, comprising:

a body having a tank that holds a liquid therein, and an outlet provided at a forward end of said body;

a piston positioned in the tank; and a piston-advancing mechanism having a knocking body that projects rearwardly of said body for advancing said piston in the tank forwardly when said knocking body is knocked in an axial direction of the liquid container, wherein a rear end of the liquid container, other than said knocking body, has a surface making an angle other than an approximate right angle with the axial direction of the liquid container, wherein said piston-advancing mechanism comprises:

a piston rod having a front end coupled to said piston, extending rearwardly of said piston, having a male thread on an outer circumferential surface thereof and prevented from rotating with respect to the tank;

a piston rod guide having a female threaded hole on a front inner circumferential surface, said female thread hole receiving said piston rod screwed thereinto;

an inner sleeve into which said piston rod is unrotatably inserted;

a rotating cam unrotatably mounted around an outer circumferential surface of said piston rod guide;

said knocking body;

a rear cap forming a rotating cam mechanism together with said rotating cam and said knocking body; and a return spring that urges said rotating cam rearwardly, wherein said rotating cam mechanism converts an amount of knock of said knocking body into an amount of rotation of said rotating cam.

6. A knock-type liquid container, comprising:

a body having a tank that holds a liquid therein, and an outlet provided at a forward end of said body;

a piston positioned in the tank; and a piston-advancing mechanism having a knocking body that projects rearwardly of said body for advancing said piston in the tank forwardly when said knocking body is knocked in an axial direction of the liquid container, wherein a rear end of the liquid container, other than said knocking body, has a surface making an angle other than an approximate right angle with the axial direction of the liquid container, wherein said piston-advancing mechanism comprises:

a piston rod having a front end coupled to said piston, extending rearwardly of said piston, having a male thread on an outer circumferential surface thereof and prevented from rotating with respect to the tank.

7. The knock-type liquid container according to claim 6, wherein said piston-advancing mechanism further comprises:

a piston rod guide having a female threaded hole on a front inner circumferential surface, said female thread hole receiving said piston rod screwed thereinto;

an inner sleeve into which said piston rod is unrotatably inserted; and a rotating cam unrotatably mounted around an outer circumferential surface of said piston rod guide.

8. The knock-type liquid container according to claim 7, wherein said piston-advancing mechanism further comprises:

a rear cap forming a rotating cam mechanism together with said rotating cam and said knocking body.

9. The knock-type liquid container according to claim 6, wherein said piston-advancing mechanism further comprises:

a spring that urges said rotating cam rearwardly.

10. The knock-type liquid container according to claim 6, wherein said rotating cam mechanism converts an amount of knock of said knocking body into an amount of rotation of said rotating cam.

11. A knock-type liquid container, comprising:

a body having a tank that holds a liquid therein, and an outlet provided at a forward end of said body;

a piston positioned in the tank; and a piston-advancing mechanism having a knocking body that projects rearwardly of said body for advancing said piston in the tank forwardly when said knocking body is knocked in an axial direction of the liquid container, wherein a rear end of the liquid container, other than said knocking body, has a surface making an angle other than an approximate right angle with the axial direction of the liquid container, wherein said piston-advancing mechanism comprises:

a piston rod having a front end coupled to said piston and extending rearwardly of said piston, having a male thread on an outer circumferential surface thereof and prevented from rotating with respect to the tank;

a rotating cam having a female threaded hole receiving the male thread of said piston rod screwed thereinto;

a ratchet sleeve through which a piston rod extends, said ratchet sleeve being fixed forwardly of said rotating cam in the tank;

a knocking cam that is positioned rearwardly of said rotating cam and can rotate said rotating cam;

the knocking body; and a knock spring that is disposed between said knocking cam and said knocking body and resiliently urges said knocking body rearwardly, wherein one of said knocking body and said knocking cam includes a projection formed thereon and the other of said knocking body and said knocking cam includes a beveled path that inclines in the axial direction and fittingly receives said projection, and wherein said rotating cam has a front end with saw-teeth formed therein and said ratchet sleeve is formed with a ratchet tooth that can mesh with the saw-teeth formed in the front end of said rotating cam and is movable to extend and retract in the axial direction.

12. A knock-type liquid container, comprising:

a body having a tank that holds a liquid therein, and an outlet provided at a forward end of said body;

a piston positioned in the tank; and a piston-advancing mechanism having a knocking body that projects rearwardly of said body for advancing said piston in the tank forwardly when said knocking body is knocked in an axial direction of the liquid container, wherein a rear end of the liquid container, other than said knocking body, has a surface making an angle other than an approximate right angle with the axial direction of the liquid container, wherein said piston-advancing mechanism comprises:

a piston rod having a front end coupled to said piston and extending rearwardly of said piston, having a male thread on an outer a circumferential surface thereof and prevented from rotating with respect to the tank; and a rotating cam having a female threaded hole receiving the male thread of said piston rod screwed thereinto.

13. The knock-type liquid container according to claim 12, wherein said piston-advancing mechanism further comprises:

a ratchet sleeve through which a piston rod extends, said ratchet sleeve being fixed forwardly of said rotating cam in the tank.

14. The knock-type liquid container according to claim 13, wherein said piston-advancing mechanism further comprises:

a knocking cam that is positioned rearward of the rotating cam and can rotate said rotating cam.

15. The knock-type liquid container according to claim 14, wherein said piston-advancing mechanism further comprises:

a knock spring that is disposed between said knocking cam and the knocking body and resiliently urges said knocking body rearwardly.

16. The knock-type liquid container according to claim 15, wherein one of said knocking body and said knocking cam includes a projection formed thereon and the other of the knocking body and the knocking cam includes a beveled path that inclines in the axial direction and fittingly receives said projection.

17. The knock-type liquid container according to claim 15, wherein said rotating cam has a front end with saw-teeth formed therein and said ratchet sleeve is formed with a ratchet tooth that can mesh with the saw-teeth formed in the front end of said rotating cam and is movable to extend and retract in the axial direction.

18. A knock-type liquid container, comprising:

a body having a tank for holding a liquid therein, and an outlet provided at a first end of said body;

a piston positioned in the tank; and a knocking body for advancing said piston in the tank when said knocking body is knocked in an axial direction of the liquid container, wherein a first end opening of the liquid container, through which the knocking body passes, defines a surface making an angle other than an approximate right angle with the axial direction of the liquid container.

19. The knock-type liquid container according to claim 18, wherein said first end of said body comprises a forward end of said body, wherein said knocking body projects rearwardly of said body for advancing said piston in the tank forwardly when said knocking body is knocked, and wherein said first end of said liquid container comprises a rear end of the liquid container.

20. A knock-type liquid container, comprising:

a body having a tank for holding a liquid therein, and an outlet provided at a first end of said body:

a piston positioned in the tank: and a knocking body for advancing said piston in the tank when said knocking body is knocked in an axial direction of the liquid container.

wherein a first end of the liquid container, other than the knocking body, has a surface making an angle other than an approximate right angle with the axial direction of the liquid container, wherein when said knocking body is at a non-knocking position, a distance in the axial direction between a rear end surface of said knocking body and a rearmost portion of the rear end of the liquid container, other than said knocking body, is selected to be equal to or less than a stroke of said knocking body required for advancing said piston.

* * * * *